United States Patent [19]

Okamoto et al.

[11] Patent Number: 4,647,238

[45] Date of Patent: Mar. 3, 1987

[54] PRINTER WITH A CONTROL FOR FEEDING DISPOSABLE RIBBON WITH MINIMUM WASTE LENGTH

[75] Inventors: Tsugio Okamoto; Yoshiharu Hirai, both of Nagoya, Japan

[73] Assignee: Brother Kogyo Kabushiki Kaisha, Aichi, Japan

[21] Appl. No.: 657,984

[22] Filed: Oct. 5, 1984

[30] Foreign Application Priority Data

Oct. 14, 1983 [JP] Japan ..... 58-193073
Oct. 14, 1983 [JP] Japan ..... 58-193074
Oct. 14, 1983 [JP] Japan ..... 58-193075

[51] Int. Cl.[4] ..... B41J 33/14

[52] U.S. Cl. ..... 400/225; 400/227; 400/232; 400/233; 400/120

[58] Field of Search ..... 400/120, 194, 195, 196, 400/196.1, 207, 208, 208.1, 225, 227, 233, 232

[56] References Cited

U.S. PATENT DOCUMENTS

| | | | |
|---|---|---|---|
| 1,682,333 | 8/1928 | Hart | 400/194 |
| 2,214,414 | 9/1940 | Myers | 400/233 |
| 3,726,381 | 4/1973 | Murphy | 400/196.1 |
| 4,074,799 | 2/1978 | Hishida et al. | 400/208 |
| 4,157,224 | 6/1979 | Purzycki et al. | 400/196 X |
| 4,420,268 | 12/1983 | Tsukamura et al. | 400/208 X |
| 4,456,392 | 6/1984 | Nozaki et al. | 400/120 |
| 4,516,137 | 5/1985 | Yasui | 400/120 X |

FOREIGN PATENT DOCUMENTS

| | | | |
|---|---|---|---|
| 0105472 | 4/1984 | European Pat. Off. | 400/208 |
| 2025719 | 8/1979 | Fed. Rep. of Germany | 400/233 |
| 0161188 | 12/1981 | Japan | 400/227 |
| 0137182 | 8/1982 | Japan | 400/225 |
| 0148681 | 9/1982 | Japan | 400/225 |
| 0176180 | 10/1982 | Japan | 400/120 |
| 0072475 | 4/1983 | Japan | 400/120 |
| 0158284 | 9/1983 | Japan | 400/196.1 |
| 0071888 | 4/1984 | Japan | 400/208 |

*Primary Examiner*—Ernest T. Wright, Jr.
*Attorney, Agent, or Firm*—Parkhurst & Oliff

[57] ABSTRACT

A printer using a disposable ribbon which is fed from a feed section toward a take-up section of a feeding device upon completion of printing of each line of characters. The printer comprises a memory for storing position data representing a feed-side end of an active portion of the ribbon which has been used for the last printed line, the feed-side end being located on the side of the feed section of the feeding device, and another memory for storing another position data representing a take-up-side end of another active portion of the ribbon which is to be used for the next line of characters, the take-up-side end being located on the side of the take-up section of the feeding device. The printer further comprises a control device for controlling the operation of the feeding device so as to feed the ribbon until the feed-side end of the active ribbon portion for the last line reaches the take-up-side of the active ribbon portion for the next line if the above feed-side end is located nearer to the feed section than the above take-up section.

10 Claims, 8 Drawing Figures

PRINTER WITH A CONTROL FOR FEEDING DISPOSABLE RIBBON WITH MINIMUM WASTE LENGTH

BACKGROUND OF THE INVENTION

The present invention relates generally to a printer, and more particularly to a printer of the type using thermal print ribbons, carbon film ribbons or other disposable or "one-time" ribbons which, once used, cannot serve any more.

Printers known in the art are designed such that a ribbon cassette or cartridge is either movable together with a print head while being supported by a carriage, or alternatively fixed to a frame of the printer and not movable. A printer according to the invention is of the latter type wherein printing is effected with a stationary ribbon cassette.

In a known printer of such a type with a stationary ribbon cassette loaded wth a disposable ribbon, an active length of the ribbon extends from a ribbon feed section (feed spool) of the cassette to a ribbon take-up section (take-up spool) of the cassette, along the length of a platen. A print head is moved along the platen to print a line of characters via the active portion of the disposable ribbon in front of the platen. Upon completion of printing of each line of characters, the disposable ribbon is fed by a distance equal to a predetermined length of a printing line, which is interpreted to mean a distance between preset right and left margin positions. In an ordinary printing, each line is not printed over its entire length. For example, some of the lines to be printed are indented (e.g., the first line of a paragraph), and most of the lines are followed by a plurality of successive spaces (the last line of a paragraph, in particular). That is, some lines of characters begin or end with a certain length of blank left after or before the preset margin positions. For such printing lines, the active portion of the disposable ribbon is not used over a distance equal to the length of the blank (successive spaces). This unused portion of the ribbon is taken up by the take-up spool, without serving for printing. Thus, the known printer with a ribbon feed arrangement as discussed above suffers a waste of a disposable ribbon, and is not satisfactory in terms of printing economy.

SUMMARY OF THE INVENTION

It is therefore an object of the present invention to provide an improved printer wherein a disposable ribbon is fed by a ribbon feeding device from its feed section to its take-up section upon completion of printing of each line of characters via an active portion of the ribbon by a printing head according to printing data temporarily stored in a buffer memory, which printer permits effective utilization of the disposable ribbon by minimizing an unused length of the ribbon which is taken up as a waste.

It is another object of the invention to provide such an improved printer which is capable of automatic tensioning of the ribbon to compensate for loosening thereof due to line feeding motions of the printer.

It is a further object of the invention to provide such an improved printer which permits an automatic feeding of an already used active portion of the disposable ribbon, immediately after the printer has been turned on or immediately before it is turned off, for making it possible to print a first line of characters in any printing operation, with a fresh active portion of the disposable ribbon.

According to the present invention, there is provided a printer wherein a disposable ribbon is fed by a ribbon feeding device from its feed section to its take-up section upon completion of printing of each line of characters via an active portion of the ribbon by a print head according to printing data temporarily stored in a buffer memory, wherein the improvement comprises: (a) first memory means for storing first position data representing a feed-side end of an active portion of the ribbon which has been used for the last printed line of characters, the feed-side end being located on the side of the feed section of the ribbon feeding device; (b) second memory means for storing second position data representing a take-up-side end of another active portion of the ribbon which is to be used for printing the next line of characters, the take-up-side end being located on the side of the take-up section of the ribbon feeding device; and (c) control means for controlling the operation of the ribbon feeding device for feeding the disposable ribbon for said next line, so as to feed the ribbon until said feed-side end of the active portion of the ribbon reaches said take-up-side end of said another active portion if said feed-side end is located nearer to the feed section of the ribbon feeding device than said take-up-side end of the ribbon.

In a printer of the invention constructed as described above, the ribbon is fed by a minimum distance necessary to print the next line of characters if the feed-side end of an active portion of the ribbon used for the last printed line is nearer to the feed section of the ribbon feeding device than the take-up-side end of another active portion of the ribbon which is to be used for printing said next line, whereby unnecessary feeding of the disposable ribbon which results in wasting an unused portion of the ribbon is minimized.

However, if the take-up-side end of said another active portion of the ribbon for the next line is nearer to the feed section of the feeding device than the feed-side end of the active portion used for the last line, the ribbon is not fed for the purpose of eliminating a waste of the ribbon. The next line is printed with a portion of the exposed length of the ribbon which has not been used for the last line. In this case, a still unused length of the ribbon between the feed-side end and the take-up-side end of the two lines is eventually taken up as a waste. While it is desired to eliminate even such a relatively small waste of the ribbon from the standpoint of running cost of the printer, the arrangement for the elimination requires modifications of the printer for enabling the ribbon feeding device to feed the ribbon in a reverse direction as well as in a forward direction in which the ribbon is normally fed. Such modifications required for bidirectional feeding of the ribbon will complicate the construction of the printer and accordingly increase the cost of manufacture. However, the above costly modifications cannot be justified by an obtained economical benefit resulting from complete elimination of a waste of the ribbon. In this regard, it is noted that an important feature of the printer of the present invention lies in the arrangement which makes it possible to minimize a waste length of a disposable ribbon with a minimum increase in the cost of manufacture of the printer.

According to one advantageous embodiment of the invention, the control means controls the operation of the ribbon feeding device so as to feed the disposable ribbon by a predetermined small distance if the feed-side end of the active portion used for the last line is nearer to the take-up section of the ribbon feeding device than the take-up-side end of the next active portion of the ribbon which is to be used for printing the next line.

Although the ribbon feeding toward the take-up section of the feeding device by a small distance according to the above embodiment results in an increase in length of waste of the ribbon rather than contributing to minimization of the ribbon waste, this arrangement is effective for preventing the exposed portion of the ribbon from being loosened or slackened more or less between the feed and take-up sections of the feed device when a line feeding action takes place for printing the next line. Stated differently, a small distance of feed of the ribbon in the above-indicated condition will give a tension to the ribbon, thereby overcoming the tendency that the exposed portion of the ribbon is slightly loosened when a sheet of paper is advanced before the next line is printed. This tendency is high particularly when the printer uses a thermal print ribbon which easily adheres to the surface of the record medium due to fusion of a thermally transferable ink layer of the ribbon. Thus, the feeding of the ribbon according to the above embodiment of the invention serves to prevent printing errors which are otherwise caused due to slack of the ribbon.

According to another advantageous embodiment of the invention, the control means controls the operation of the ribbon feeding device, after the printer has been turned on and before a first line of characters is printed, so as to feed the disposable ribbon by a distance sufficient to print the first line of characters without using any segment of the active portion of the ribbon which was used for the last line printed in the last printing operation.

The above embodiment is significant in view of the situation that the disposable ribbon is not fed after the last line has been printed, that is, an active portion of the ribbon which was used for the last printed line in the last printing job remains in position when a first line is printed in the next printing job. In the above embodiment wherein the ribbon is fed by a suitable distance before the first line is printed, any segment of the ribbon used for the last line in the last printing job will not be used.

In accordance with one form of the above embodiment of the invention, the ribbon is fed by a predetermined distance corresponding to a preset maximum number of characters printable per line, less a distance of a blank which is to be left before a first character of the first line of characters, after the printing data for the first line has been stored in the buffer memory and before the first line is printed. In this case, a minimum distance of the ribbon feeding required for the first line is calculated immediately after the printing data for the first line has been stored in the buffer memory. The ribbon is fed by the calculated minimum required distance before the first line is printed. However, if a blank was left after the last character of the last line printed in the last printing job, a length of the ribbon corresponding to a distance of that blank is not used and therefore wasted.

According to another form of the above embodiment, the ribbon is fed by a predetermined distance corresponding to a preset maximum number of characters printable per line, during an initializing routine which is executed immediately after the printer has been turned on. In this case, too, the first line is printed without using any segment of the ribbon which was used in the last printing job.

According to a further embodiment of the invention alternative to the above described embodiment, the control means controls the operation of the ribbon feeding device so as to feed the disposable ribbon during a terminating routine which is executed when the printer is turned off. In this embodiment, the ribbon is fed by a predetermined distance corresponding to a preset maximum number of characters printable per line, less a distance corresponding to a distance of a blank which is left after the last character of the line which has been printed last before the printer is turned off.

Thus, the above two embodiments of the invention permit automatic feeding of the ribbon by a distance equal to a preset maximum printable line length, or by the preset maximum printable line length minus a distance of a blank which is to be left before the first character of the first line or which was left after the last character of the last line in the last printing operation. This ribbon feeding is effected after the printer has been turned on and before the first line is printed, or during an initializing routine which is executed immediately after the printer has been turned on, or during a terminating routine which is executed when the printer is turned off.

BRIEF DESCRIPTION OF THE DRAWING

The above and other objects, features and advantages of the present invention will be better understood from reading the following description of the preferred embodiments taken in connection with the accompanying drawings in which.

DETAILED DESCRIPTION OF THE PREFERRED EMBODIMENTS

Referring to the accompanying drawings, preferred embodiments of the invention will be described in detail.

Figures 1A, 1B:
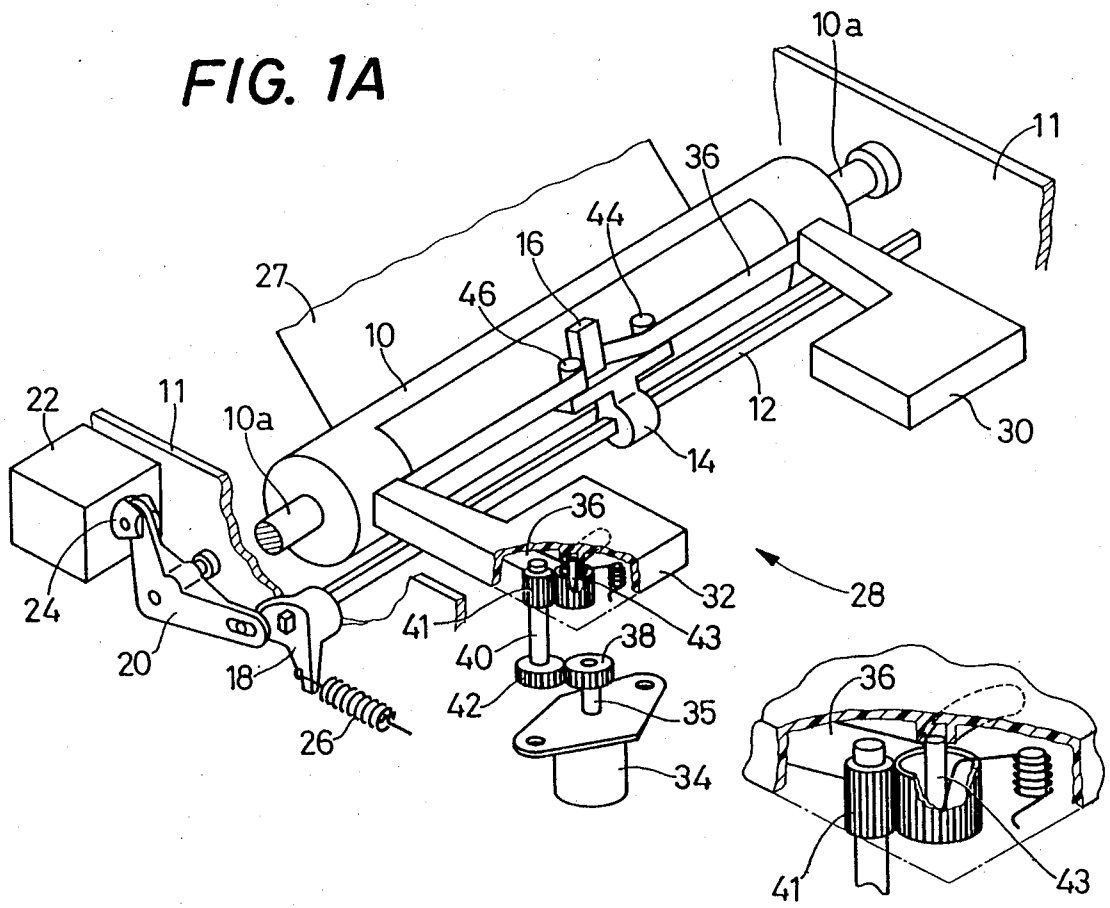
FIG. 1A is a fragmentary perspective view of one embodiment of a printer of the invention in the form of a thermal printer.
FIG. 1B is an enlarged, partially broken away view of the ribbon take-up cassette depicted in FIG. 1A.

There are shown in FIGS. 1A and 1B mechanically operated elements of one embodiment of a printer of the invention in the form of a thermal printer. In the figures, reference numeral 10 designates a platen which has shaft portions 10*a*, 10*a* extending concentrically from opposite ends thereof. The platen 10 is rotatably supported at the shaft portions 10*a*, 10*a* by a frame 11 of the printer, and rotated by a paper feed motor 86 (FIG. 2) in a known manner. Along the length of the platen 10, there is disposed a guide bar 12 of rectangular cross sectional shape. The guide bar 12 supports a carriage 14 so that the carriage 14 is slidably movable on the guide bar 12. The carriage 14 carries a print head in the form of a thermal print head 16, which is movable along a line of printing on the platen 10 when the carriage 14 is moved on the guide bar 12 by a carriage feed motor 84 (FIG. 2) in a known manner.

The guide bar 12 is pivotally supported by the printer frame 11, and operatively connected to a plunger 24 of a head release solenoid 22 via a two-arm lever 18 fixed to one end of the bar 12, and another two-arm lever 20. The lever 18 is biased by a spring 26 in a counterclockwise direction (as viewed in FIG. 1A), so that the thermal print head 16 is held in its operated position at which the head 16 is in contact with the surface of the platen 10 (with the surface of a record medium 27, e.g., a sheet of paper). Upon inward movement of the plunger 24 as a result of energization of the solenoid 22, the guide bar 12 is rotated clockwise against a biasing force of the spring 26, whereby the thermal print head 16 is separated from the platen 10 and placed in its inoperative position.

Adjacent the plate 10 is disposed a ribbon feeding device generally indicated at 28. This ribbon feeding device 28 comprises a ribbon feed section in the form of a ribbon feed cassette 30, a ribbon take-up section 32 in the form of a ribbon take-up cassette 32, a ribbon feed motor 34, and other elements which will be described. The ribbon feed and take-up cassettes 30, 32 are removably or replaceably mounted on the printer frame. A disposable ribbon in the form of a thermal print ribbon 36 wound in the ribbon feed cassette 30 is directed to the take-up cassette 32 along the length of the platen 10, so that the ribbon 36 is rewound in the take-up cassette 32 after it has been used for printing. That is, the thermal print ribbon 36 (hereinafter simply called ribbon) is always exposed by a distance between the outlet of the feed cassette 30 and the inlet of the take-up cassette 32, so that the exposed length of the ribbon 36 includes an active portion which is used for printing desired characters on the record medium 27 on the platen 10.

The ribbon feed drive motor 34 is fixed to the printer frame 11, and has an output shaft 35 to which is fixed a gear 38. A ribbon feed shaft 40 is rotatably supported by the printer frame 11 and connected to a ribbon drive roller 41 in the take-up cassette 32. The feed shaft 40 is provided at its end with a gear 42 which engages the gear 38 on the output shaft 35 of the ribbon feed drive motor 34, whereby a rotary motion of the drive motor 34 is transmitted to a ribbon take-up spool 43 in the take-up cassette 32, via the gears 38, 42, shaft 40 and the ribbon drive roller 41. Thus, the ribbon 36 is fed and rewound on the ribbon take-up spool 43 in the take-up cassette 32. As is apparent from the above description, the ribbon feeding device 28 of the present embodiment comprises the ribbon feed and take-up cassettes 30, 32, ribbon feed drive motor 34, drive motor output shaft 35, gears 38, 42, ribbon feed shaft 40, and the ribbon drive roller 41 and ribbon take-up spool 43 housed in the take-up cassette 32.

The exposed portion of the ribbon 36 running from the cassette 30 to the cassette 32 is directed to pass between the platen 10 and the thermal print head 16 while it is guided by two ribbon guides 44, 46 rotatably supported on the carriage 14.

Figure 2:
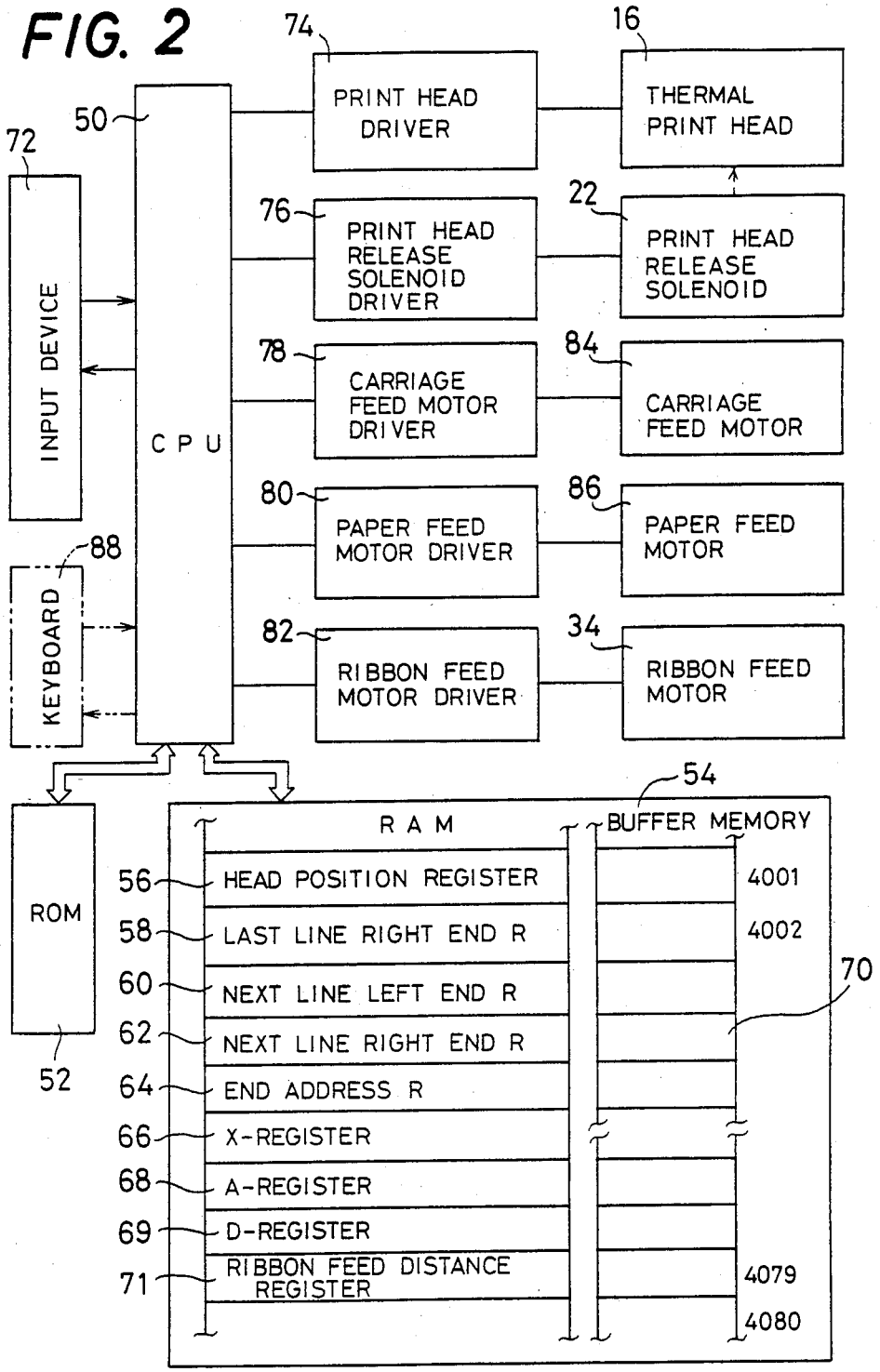
FIG. 2 is a schematic block diagram showing a control system of the printer of FIG. 1.

The printer with the mechanical construction which has been described is operated under control of a control system (electronic circuitry) as shown in the schematic block diagram of FIG. 2. In the figure, reference numeral 50 indicates a central processing unit (hereinafter referred to as "CPU 50") which is connected to a read-only-memory 52 (hereinafter referred to as "ROM 52") and to a random-access-memory 54 (hereinafter called "RAM 54"). The CUP 50, ROM 52 and RAM 54 are constituted by a microcomputer. The ROM 52 permanently stores programs which are necessary for controlling the operation of the printer. The RAM 54 includes the following registers: HEAD POSITION register 56; LAST LINE RIGHT END register 58; NEXT LINE LEFT END register 60; NEXT LINE RIGHT END register 62; END ADDRESS register 64; X-register 66; A-register 68; D-register 69; and RIBBON FEED DISTANCE register 71. The RAM 54 further includes a buffer memory 70.

While the contents of data to be stored in the above indicated registers will become apparent from the later description of events of operation of the printer, the storage contents of some of the registers are briefly described here. The LAST LINE RIGHT END register 58 serves as memory means for storing first position data representing a feed-side end of an active portion of the ribbon 36 which has been used for the last printed line of characters. The feed-side end is interpreted as the end of the used active portion of the ribbon 36 which is located on the side of the ribbon feed cassette 30 (feed section of the feeding device 28). The NEXT LINE LEFT END register 60 serves as another memory means for storing second position data representing a take-up-side end of another active portion of the ribbon 36 which is to be used for printing the next line of characters. The take-up-side end is interpreted as the end of said another active portion of the ribbon 36 which is located on the side of the ribbon take-up cassette 32 (take-up section of the feeding device 28). The buffer memory 70 is provided to temporarily store printing data representing a line of characters to be printed. In the case where the printer has a maximum printing capacity of 80 characters per line, for example, the buffer memory 70 uses 80 addresses, e.g., address No. 4001 through address No. 4080.

The CPU 50 is connected to an external input device 72 to supply character and space codes received from the input device 72 to the printer. The character codes represent characters such as letters, digits and symbols, and the space code represents a space. In this application, the term "character" does not include a space. The CPU 50 is further connected to various driver circuits such as a print head driver 74, a print head release solenoid driver 76, a carriage feed motor driver 78, a paper feed motor driver 80 and a ribbon feed motor driver 82, which receive signals from the CPU 50 and control the operations of the thermal print head 16, print head release solenoid 22, carriage feed motor 84, paper feed motor 86, and ribbon feed motor 34, respectively. In the present embodiment, the CPU 50, ROM 52 and ribbon feed motor driver 82 constitute control means for controlling the operation of the ribbon feeding device 28 which is driven by the ribbon feed motor 34.

Figure 3:
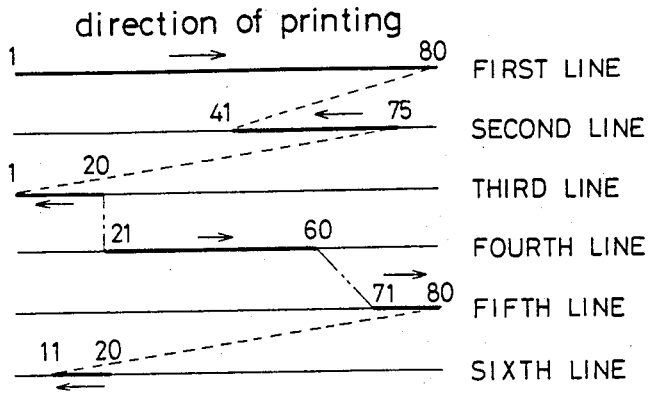
FIG. 3 is a diagrammatic illustration of a document printed by the printer.

The printing operation of this embodiment of the printer will be described next, referring to a diagrammatic illustration of FIG. 3 which shows an example of a printing cycle. In the figure, thick solid lines represent lines of characters (excluding spaces) which are printed using the disposable ribbon 36, and thin solid lines represent lines of spaces (blanks) in which no letters, digits or symbols are printed. Arrows along the thick solid lines indicate directions in which the lines of characters are printed. Broken lines indicate feeding movements of the disposable ribbon 36 upon line feeding movements of the platen 10. Two-dot chain lines indicate a line feeding movement of the platen 10 without a feeding movement of the ribbon 36.

Upon application of power to the printer, the CPU 50 executes an initializing routine in which the registers such as the HEAD POSITION register 56, and the buffer memory 70 are cleared. When a printing start command is generated from the input device 72, the CPU 50 operates according to a program stored in the ROM 52. The CPU 50 first reads out printing data for the first line which has been stored in the input device 72, and transfers the read-out printing data to the buffer memory 70. Based on the printing data stored in the buffer memory 70, the print head driver 74 and the carriage feed motor driver 78 are controlled to operate the thermal print head 16 and the carriage feed motor 84, respectively. As a result, the first line of characters is printed. Since the program for such a printing operation is well known in the art, and has no direct relation with the subject matter of the present invention, no further description of the printing operation itself will be given herein, and the following description refers only to events of operations which relate to feeding of the ribbon 36.

Figure 4A:
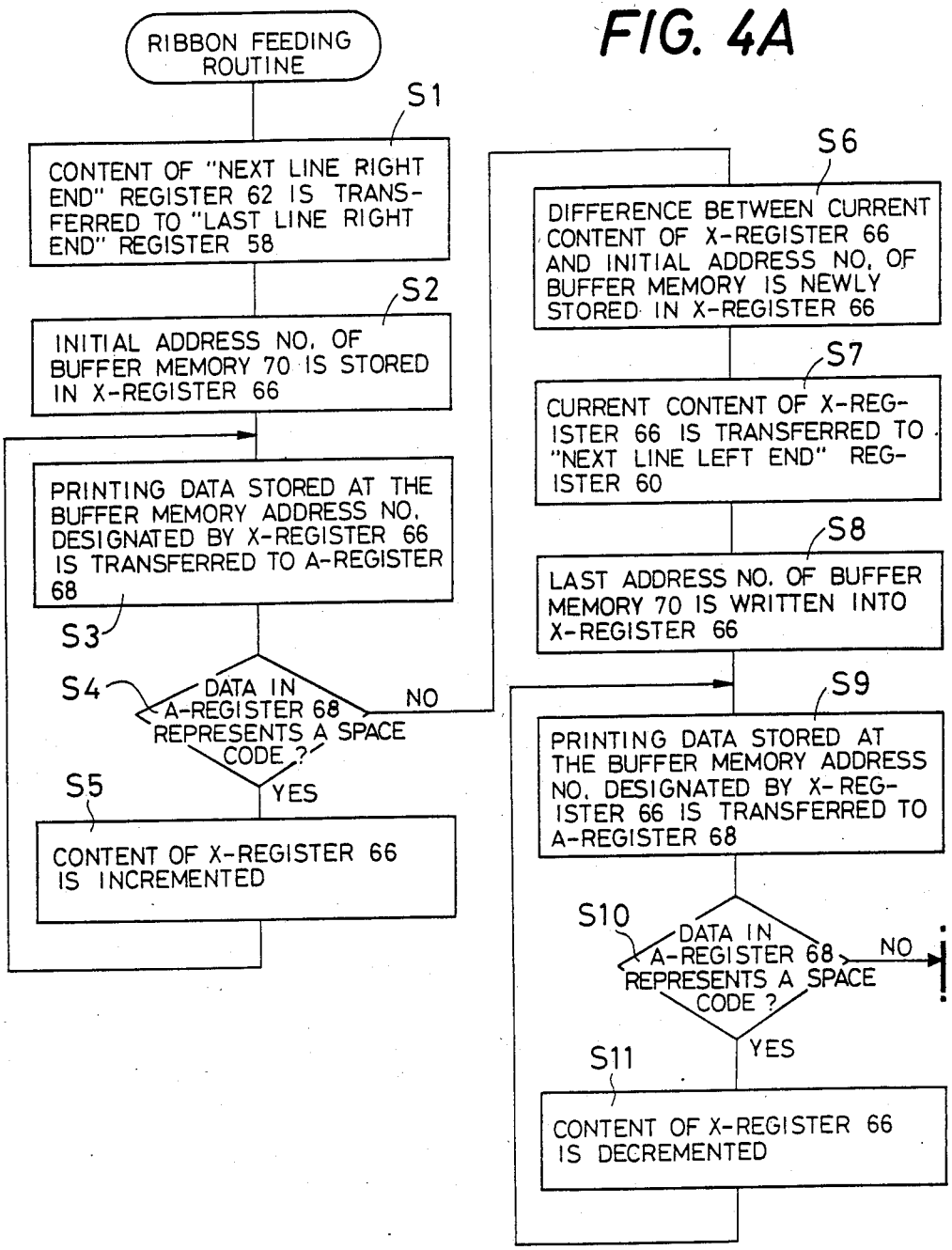
FIGS. 4A and 4B provide a flow chart illustrating a program (ribbon feeding routine) for controlling ribbon feeding operations of the printer.
Figure 4B:
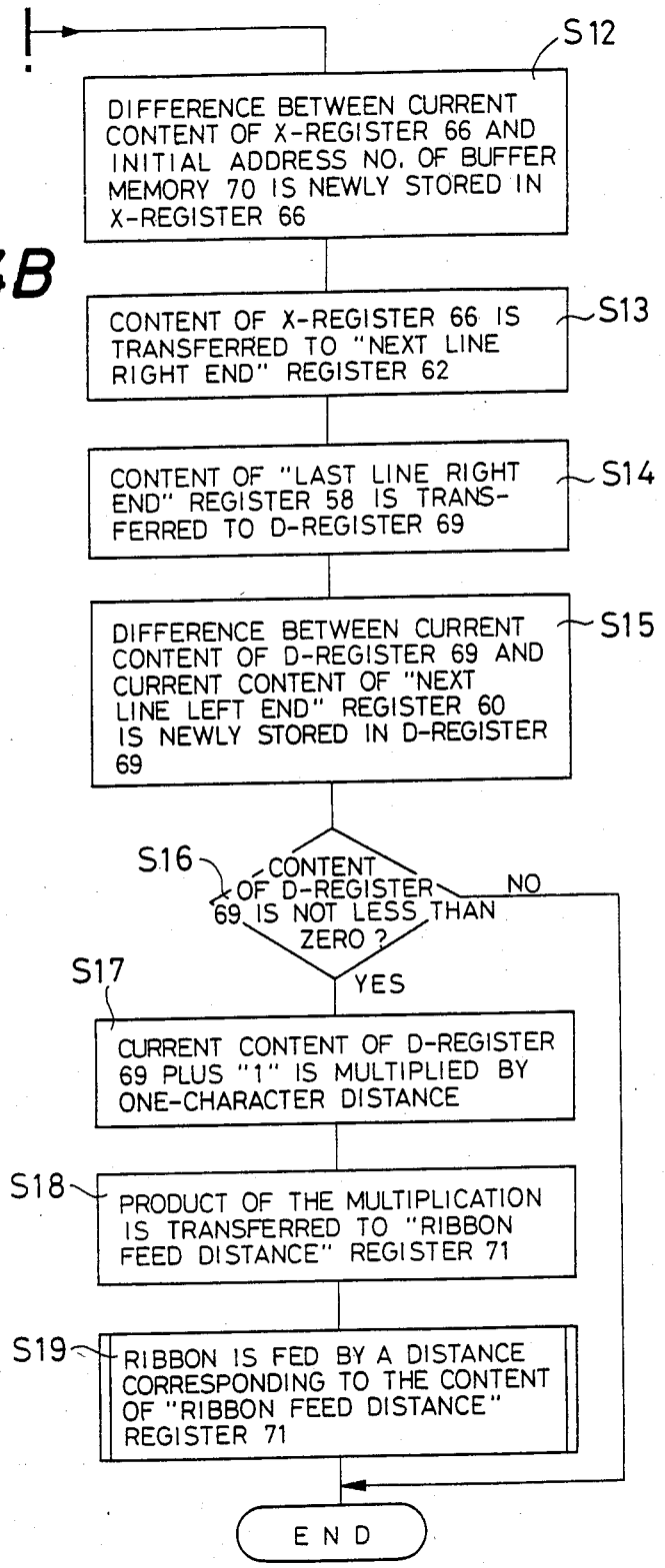

When the printing data for the first printing line has been transferred to the buffer memory 70, a ribbon feeding routine as shown in FIGS. 4A and 4B will be executed. At first, step S1 is executed wherein a numerical value (position data) stored in the NEXT LINE RIGHT END register 62 is written into the LAST LINE RIGHT END register 58. Since the NEXT LINE RIGHT END register 62 has been cleared upon execution of an initializing routine, the numerical value stored in the register 62 is "0" (zero) and therefore "0" is stored in the LAST LINE RIGHT END register 58. Then, the CPU 50 goes to step S2 wherein the first address No. "4001" of the buffer memory 70 is written into the X-register 66. Step S2 is followed by step S3 wherein printing data is stored at the address No. 4001 of the buffer memory 70 (designated by the X-register 66) is written into the A-register 68. The printing data transferred to the A-register 68 is then checked in step S4 to see whether the data represents a space code or not. In the instant example, the leftmost position of the first line is not a space as shown in FIG. 3, the result of this checking in step S4 is "NO" (negative) and the CPU 50 goes to step S6. In this step S6, the initial address No. (i.e., "4001") of the buffer memory 70 is subtracted from the current numerical value stored in the X-register 66. At this point of time, the initial address No. "4001" of the buffer memory 70 is stored in the X-register 66, the result of the above subtraction is "0" (zero), whereby the value "0" is newly stored in the X-register 66. Then, in step S7, the content of the X-register 66 is transferred to the NEXT LINE LEFT END register 60. Step S7 is followed by step S8 wherein the address No. of the buffer memory 70 at which the last printing data of the first line is stored, is written into the X-register 66. As shown in FIG. 3, the length of each printing line is set to include a maximum of 80 characters (including spaces). That is, a maximum number of characters printable per line is preset at "80", which is determined by predetermined left and right margin positions. Therefore, a numerical value "4080" is written in the X-register 66 in step S8. In the following step S9, the printing data stored at the address No. "4080" of the buffer memory 70 (address No. designated by the X-register 66) is transferred to the A-register 68. Successively, the CPU 50 goes to step S10 to check if the printing data in the A-register 68 represents a space code or not. As shown in FIG. 3, the rightmost position of the first line is not a space, and the result of checking in step S10 is "NO". Accordingly, the CPU 50 then goes to step S12 wherein the initial address No. "4001" of the buffer memory 70 is subtracted from the current content "4080" of the X-register 66, and the difference "79" is stored in the X-register 66. The stored value "79" is transferred in step S13 to the NEXT LINE RIGHT END register 62. In the following step S14, the data representing the right end of the last line, i.e., the numerical value "0" stored in the LAST LINE RIGHT END register 58 in step S1 is written into the D-register 69. In the next step S15, the data representing the left end of the next line, i.e., the value "0" stored in step S7 in the NEXT LINE LEFT END register 60 is subtracted from the current content of D-register, and the difference "0" is newly stored in the D-register 69. Subsequently, the CPU 50 goes to step S16 to check if the updated content of the D-register 69 is greater than or equal to "0". Since the current content of the D-register 69 is zero, the CPU 50 goes to step S17 wherein the ribbon feeding distance is calculated by multiplying the current content of the D-register 69 plus "1", by a unit distance "5" corresponding to one character-to-character distance. Since the content of the D-register 69 is "0", the product of the multiplication is equal to the unit distance "5". This value is stored into the D-register 69. In the next step S18, the content "5" of the D-register 69 is transferred to the RIBBON FEED DISTANCE register 71. Then, in step S19, the disposable ribbon 36 is fed by a distance corresponding to the current content of the RIBBON FEED DISTANCE register 71, that is, by the predetermined character-to-character distance "5". By this small distance of the ribbon feed, a possible slight slack of the exposed portion of the ribbon 36 between the ribbon feed and take-up cassettes 30, 32 may be eliminated before printing the first line.

After the above events of operations have been executed, the first line of characters is printed. Upon completion of the printing of the first line, printing data for the second line is transferred from the input device 72 to the buffer memory 70. Then, a similar cycle according to the program shown in FIGS. 4A and 4B is again executed for the second line. In step S1 in this cycle, the content of the NEXT LINE RIGHT END register 62 which was set at "79" in step S13 in the preceding cycle, is written in the LAST LINE RIGHT END register 58. Since the printing data which is written into the A-register 68 in step S3 is a space code as indicated in FIG. 3, the result of checking in step S4 is "YES" and the CPU 50 goes to step S5 wherein the content of the X-register 66 is incremented by "1". Then, the CPU 50 goes back to step S3. These steps S3–S5 are repeated as long as the content of the A-register 68 is a space code. When the address No. of the buffer memory 70 stored in the X-register 66 has become equal to "4041", no space code is written into the A-register 68 in step S3. Consequently, the result of checking in step S4 is "NO", and the CPU 50 goes to step S6. In this step S6, the initial address No. "4001" of the buffer memory 70 is subtracted from the current content "4041" of the X-register 66. The difference "40" is then newly stored in the X-register 66. The step S6 is followed by step S7 wherein the value "40" in the X-register 66 is written into the NEXT LINE LEFT END register 60. In the following step S8, the last address No. "4080" of the buffer memory 70 is written into the X-register 66. Then, in the next step S9, the printing data stored at the last address No. "4080" of the buffer memory 70 which is designated by the content of the X-register 66, is then transferred to the A-register 68. As indicated in FIG. 3, the last position of the second line is a space, the judgement in the next step S10 is "YES", whereby the CPU 50 goes to step S11 wherein the content of the X-register 66 is decremented by "1". The CPU 50 then goes back to step S9. The same sequence of steps S9 through S11 is repeated for checking the printing data for the successive positions of the second line from the rightmost end toward the leftmost end, to see whether the data is a space code or not, and for decrementing the current content of the X-register 66 if the printing data is a space code. As shown in FIG. 3, the printing data at the address No. "4075" of the buffer memory 70 is a space code. Accordingly, the result of checking in step S10 becomes "NO" when the content of the X-register 66 has been decremented to "4075". At this time, the CPU 50 goes to step S12 wherein the initial address No. "4001" of the buffer memory 70 is subtracted from the current content "4075" of the X-register 66, and the difference "74" is newly stored in the X-register 66. The content "74" of the X-register 66 is transferred in step S13 to the NEXT LINE RIGHT END register 62. Subsequently, the CPU 50 goes to steps S14, S15 and S16. Since the content of the LAST LINE RIGHT END register 62 (content of the D-register 69) is "79" while the content of the NEXT LINE LEFT END register 60 is "40", the result of checking in step S16 is "YES". Hence, the CPU 50 goes to step S17 wherein the current content "39" of the D-register 69 (difference between the values "79" and "40") plus "1", that is, a numerical value of "40" is multiplied by the predetermined unit feed amount "5" which corresponds to one character-to-character distance. The product of this multiplication is newly stored in the D-register 69 as a ribbon feed distance. In the following step S18, the content of the D-register 69 is transferred to the RIBBON FEED DISTANCE register 71, and the ribbon 36 is fed in the next step S19 according to the data in the register 71.

In the above arrangement for the ribbon feeding, the second line is printed by using an active portion of the ribbon 36 which immediately follows an active portion of the ribbon 36 which was used for the first line. More specifically described, the ribbon 36 is fed only by a distance corresponding to 40 characters before the second line is printed. In other words, the distance of feed of the ribbon 36 prior to printing the second line is a distance corresponding to 80 characters (preset maximum number of characters printable per line), less a distance of a blank to be left before the first letter (numeral or symbol) of the second line. Accordingly, the length of the ribbon 36 corresponding to the blank between the first and 40th positions of the second line will not be wasted. This is contrary to the known arrangement in which a ribbon is fed by a full distance corresponding to a preset length of a printing line (distance between present right and left margin positions) after each line is printed. As is apparent from the foregoing description, the term "active portion" of the ribbon 36 should be interpreted to mean a length of the ribbon 36 which has been or will be used for printing characters such as letters, numerals and symbols (excluding spaces).

The similar sequence of operation according to the program indicated by the flow chart of FIGS. 4A and 4B will be executed for the third and subsequent lines, after the printing data for each of those lines has been transferred to the buffer memory 70. Before the third line is printed, the ribbon 36 is fed by a distance corresponding to a difference between the right end position value "74" of the second line and the left end position value "0" of the third line, plus "1", that is, the ribbon 36 is fed by a distance corresponding to 75 characters. After the third line has been printed and before the fourth line is printed, the ribbon 36 is not fed because a negative difference is obtained in step S15 as a result of subtracting the left end position value "20" of the fourth line from the right end position value "19" of the third line, and the judgement in step S16 is "NO". Similarly, the ribbon 36 is not fed before the fifth line is printed. Absence of the ribbon feeding upon line feeding is indicated in two-dot chain line in FIG. 3. Before the sixth line is printed, the judgement in step S16 is "YES", and the ribbon 36 is fed by a distance corresponding to 70 $(79-10+1)$ characters.

As is apparent from the foregoing description, the disposable ribbon 36 is fed as needed so as to provide an unused active portion for each line of characters (excluding spaces) to be printed. In this arrangement according to the invention, the printing operation can be effected not only in the forward direction as in printing the first, fourth and fifth lines, but also in the reverse direction as in printing the second, third and sixth lines.

Figure 5:
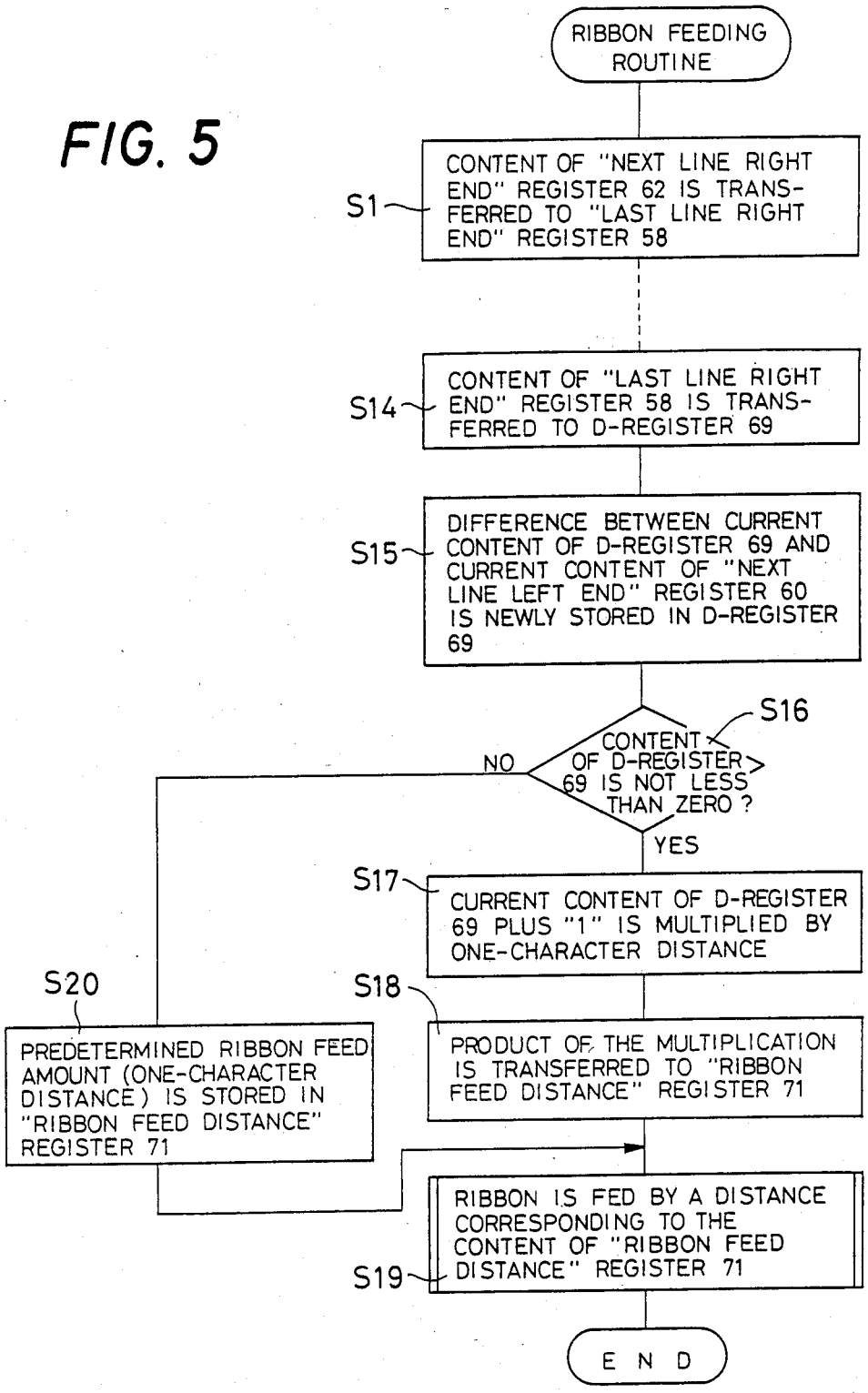
FIG. 5 is a flow chart illustrating a part of a program (ribbon feeding routine) for controlling ribbon feeding operations of another embodiment of the invention.

Referring to FIG. 5, a modified embodiment of the printer of the invention will be described. This modified embodiment is different from the preceding embodiment of FIGS. 1A–4B only in that an additional step S20 is executed when the difference of the content of the LAST LINE RIGHT END register 58 from the content of the NEXT LINE LEFT END register 60 is less than zero, that is, when the judgement in step S16 is "NO". More particularly described, when the right end position of the last printed line is nearer to the left margin position than the left end position of the next line to be printed, a negative value is stored in the D-register 69 in step S15. For example, before the fourth line of FIG. 3 is printed, the left end position value "20" of the fourth line is subtracted from the right end position value "19" of the third line. Since the difference obtained from the above subtraction in step S15 is "−1" negative), the judgement in step S16 is "NO", and the CPU 50 goes to step S20. In this step S20, a predetermined ribbon feed amount "5" which corresponds to one character-to-character distance is stored in the RIBBON FEED DISTANCE register 71. Consequently, the ribbon 36 is fed in step S19 by a distance corresponding to one character before the fourth line is printed. Similarly, the ribbon 36 is fed by the one-character distance before the fifth line is printed.

Although a feeding movement of the ribbon 36 prior to the printing of the fourth and fifth lines is not necessary for the purpose of avoiding the use of an already used portion of the ribbon 36, the present modified embodiment is adapted to feed the ribbon 36 by a predetermined small distance (corresponding to one character). This modification is intended to eliminate otherwise possible slack of the ribbon 36 if it is not fed after its active portion has been used for printing. After each line has been printed, the used active portion of ribbon 36 is separated from the paper on the platen 10, together with the thermal print head 16, so that the paper can be fed smoothly to the next line. During this movement of the active portion of the ribbon 36, a tension is applied to the ribbon 36 due to adhesion of the used active portion to the surface of the paper, whereby the spool in the ribbon feed cassette 30 may be rotated with a tensile force applied to the ribbon 36. Thus, the ribbon 36 tends to be loosened in a slight degree upon line feeding movements of the printer. This looseness of the ribbon 36 is automatically removed in the modified embodiment wherein the ribbon 36 is fed by only one-character distance even when the right end position of the last printed line is nearer to the left margin position (nearer to the inlet of the ribbon take-up cassette 32) than the left end position of the next line to be printed. In the modified embodiment of FIG. 5, therefore, the exposed portion of the ribbon 36 is always given a suitable tension, that is, the ribbon 36 is protected against otherwise possible downward displacement at its active portion. Accordingly, the modified arrangement of FIG. 5 is effective in preventing printing errors (printing failure at upper segments of characters) due to downward dislocation of the ribbon 36 relative to the print head 16.

While the above described second embodiment of the invention is particularly effective when the printer uses a thermally transferable ink ribbon, the principle of the invention may be applied when the printer uses other types of disposable or "one-time" ribbons such as a carbon film ribbon.

A third embodiment of the invention will be described next.

Figure 6:
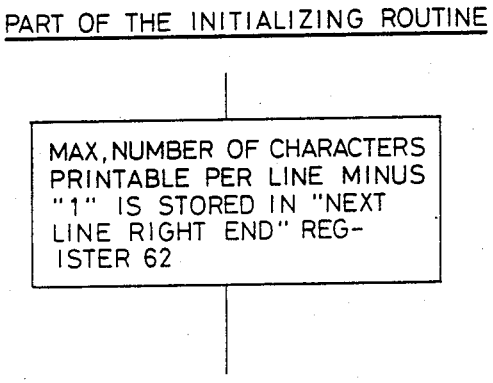
FIG. 6 is a fragmentary flow chart showing a part of an initializing routine of a further embodiment of the invention.

This third embodiment is different from the preceding embodiment in the initializing routine which is executed by the CPU 50, upon power application to the printer, according to a program stored in the ROM 52. As described in connection with the first embodiment, the various registers such as the HEAD POSITION register 56, and the buffer memory 70 are cleared in the initializing routine. However, the initializing routine in the third embodiment additionally includes a step shown in FIG. 6. In this step, a maximum number of characters printable per line which is preset by right and left margin positions, is stored in the NEXT LINE RIGHT END register 62. For example, if the maximum number of characters printable in each line is set at 80 as shown in FIG. 3, a numerical value "80" minus "1", i.e., a value "79" is stored in the NEXT LINE RIGHT END register 62 during the execution of the initializing routine.

When a printing start command is generated after the initializing routine including the above indicated step has been executed, the CPU 50 starts transferring printing data for a first line from the input device 72 to the buffer memory 70, according to a program which is also stored in the ROM 52. The following description is based on the assumption that no spaces are left before a first character of the first line, as in the first line of FIG. 3. As soon as the printing data for the first line has been transferred to the buffer memory 70, the CPU 50 executes the previously described ribbon feeding routine shown in FIG. 4. In step S1, the value stored in the NEXT LINE RIGHT END register 62 is written into the LAST LINE RIGHT END register 58. As stated in the preceding paragraph, the value "79" has been stored in the NEXT LINE RIGHT END register 62 while the initializing routine was executed. Hence, in step S1, this value "79" is stored in the LAST LINE RIGHT END register 58. Subsequently, steps S2 through S13 are executed in the same manner as previously discussed. In step S14, the content "79" of the LAST LINE RIGHT END register 58 is stored in the D-register 69. In the next step S15, the current content of the NEXT LINE LEFT END register 60 is subtracted from the content "79". In this specific example wherein no spaces are present before the first character of the first line, the content of the NEXT LINE LEFT END register 60 has been set at "0" in step S7. Therefore, the difference "79" is newly stored in the D-register 69 in step S15. Since this value "79" is not less than "0", the result of checking in step S16 is "YES", whereby the CPU 50 goes to step S17 in which the current content "79" of the D-register 69 plus "1" is multiplied by the predetermined one-character distance (unit distance of ribbon feed). As a result, the ribbon feed distance corresponding to 80 characters is stored in the RIBBON FEED DISTANCE register 71 in the following step S18, whereby the ribbon 36 is fed in step S19 by a distance corresponding to the preset maximum number of characters printable per line, i.e., 80 characters.

If, for example, 40 spaces are left in the first line, steps S3–S5 are repeated 40 times, and consequently the content of the NEXT LINE LEFT END register 60 is set at "40" in step S7. Accordingly, the difference obtained in step S15 is "79" minus "40", i.e., "39", whereby the ribbon 36 is fed by a distance corresponding to 40 (39+1) characters. In other words, the distance of the ribbon feeding prior to printing the first line is a distance corresponding to the preset maximum number of characters printable per line (80 characters), less a distance of a blank (40 spaces) which is to be left before the first character of the first line.

As described above, the third embodiment of the invention is equipped with control means for controlling the operation of the ribbon feeding device 28, after the printing data for the first line has been transferred to the buffer memory 70 and before the first line is printed, so that the disposable ribbon 36 is fed by a distance sufficient to print the first line without using any segment of an active portion of the ribbon 36 which was used for the last line printed in the last printing operation. This control means comprises: the ROM 52 which stores the programs for the initializing routine and the ribbon feeding routine; the CPU 50; the RAM 54; and the ribbon feed motor driver 82. With this control arrangement wherein the initializing routine includes the step of FIG. 6, the entire portion of the ribbon 36 which was used for the last printed line in the preceding printing job will be fed toward the take-up cassette 32 and not used for printing the first line of a document to be printed, even if 80 characters were printed in the last line in the last job. Thus, an unused active portion of the ribbon 36 is set ready for use before the first line is printed in each printing operation.

Although the third embodiment described above is adapted to feed the ribbon 36 by a preset maximum printing length minus a distance of a blank to be left before the first character of the first line, it is possible that the ribbon 36 can be fed by the preset maximum printing length (corresponding to a preset distance between right and left margin positions), during execution of the initializing routine (before the printing data for the first line has been transferred to the buffer memory 70), irrespective of the printing start position of the first line (irrespective of a distance of a blank before the first character). In this case, all registers of the RAM 54 including the NEXT LINE RIGHT END register 62 should be cleared before the printing data for the first line has been transferred to the buffer memory 70.

It is appreciated that the ribbon 36 can be fed during a terminating routine which is executed when the printer is turned off. In this case, the ribbon 36 is fed by a predetermined distance corresponding to a preset maximum number of characters printable per line, less a distance corresponding to a distance of a blank which is left after the last character of the line which has been printed last before the printer is turned off.

While the present invention has been described in its preferred embodiments, it is to be understood that the invention is not limited thereto; but may be otherwise embodied.

For example, the ribbon 36 which, in the illustrated embodiments, is fed from the right end toward the left end of a printing line, may be fed in the opposite direction from the left end toward the right end of the printing line. Further, it is appreciated that the present invention can be applied to a printer which is not equipped with a thermal print head, that is, to a printer which uses a carbon film ribbon or other disposable or "one-time" ribbon, rather than a ribbon having a thermally transferable ink layer.

Although the illustrated embodiments of the printer of the invention are operated in conjunction with the input device 72 which stores all printing data for a document to be printed, it is possible that the printer of the invention can be connected to an input device which supplies printing data to the printer (CPU 50) concurrently with data input through a keyboard (as indicated at 88 in phantom line in FIG. 2), as in a typewriter. In this instance, however, the printer should have a buffer memory (as indicated at 70 in FIG. 2) which temporarily stores printing data for a single line of characters before that line of characters is printed. Further, it is possible to modify, as needed, the program which is used in the illustrated embodiments to determine a ribbon feeding amount.

It will be obvious that other changes and modifications may occur to those skilled in the art within the scope of the invention defined in the appended claims.

What is claimed is:

1. In a printer wherein a disposable ribbon is fed by a ribbon feeding device from its feed section to its take-up section upon completion of printing of each line of characters via an active portion of the ribbon by a printing head according to printing data temporarily stored in a buffer memory, the improvement comprises:

first memory means for storing first position data representing a feed-side end of an active portion of said disposable ribbon which has been used for the last printed line of characters, said feed-side end being located on the side of said feed section of the ribbon feeding device;

second memory means for storing second position data representing a take-up-side end of another active portion of the disposable ribbon which is to be used for printing the next line of characters, said take-up-side end being located on the side of said take-up section of the ribbon feeding device; and control means for controlling the operation of said ribbon feeding device for feeding said disposable ribbon for said next line, so as to feed said ribbon until said feed-side end of said active portion of the ribbon reaches said take-up-side end of said another active portion if said feed-side end is located nearer to said feed section of the ribbon feeding device than said take-up side end.

2. A printer as claimed in claim 1, wherein said control means controls the operation of said ribbon feeding device so as to feed said disposable ribbon by a predetermined small distance if said feed-side end is located nearer to said take-up section of the ribbon feeding device than said take-up-side end.

3. A printer as claimed in claim 1, wherein said control means controls the operation of said ribbon feeding device, after said printer is turned on and before a first line of characters is printed, so as to feed said disposable ribbon by a predetermined distance corresponding to a preset maximum number of characters printable per line, less a distance of a blank which is to be left before a first character of said first line, whereby the first line is printed without using any segment of the active portion of the ribbon which was used for the last line in the last printing operation.

4. A printer as claimed in claim 1, wherein said control means controls the operation of said ribbon feeding device, during an initializing routine executed immediately after the printer is turned on, so as to feed said disposable ribbon by a predetermined distance corresponding to a preset maximum number of characters printable per line.

5. A printer as claimed in claim 1, wherein said control means controls the operation of said ribbon feeding device so as to feed said disposable ribbon, during a terminating routine executed when the printer is turned off, by a predetermined distance corresponding to a preset maximum number of characters printable per line, less a distance corresponding to a distance of a blank which is left after a last character of the line which has been printed last before the printer is turned off.

6. A printer as claimed in claim 1, wherein the printing operation by said print head is effected bidirectionally in selected one of opposite directions along the line of characters to be printed.

7. A printer as claimed in claim 1, wherein said ribbon feeding device feeds said disposable ribbon in a direction from a right end toward a left end of the line of characters to be printed.

8. A printer as claimed in claim 1, wherein said print head is a thermal print head and said disposable ribbon is a ribbon comprising a layer of thermally transferrable ink.

9. A printer as claimed in claim 1, wherein said disposable ribbon is a carbon film ribbon.

10. In a printer wherein a disposable ribbon is fed by a ribbon feeding device from its feed section to its take-up section upon completion of printing of each line of characters via an active portion of the ribbon by a print head according to printing data temporarily stored in a buffer memory, the improvement comprising:

control means for controlling the operation of said ribbon feeding device, after the printing data for a first line of characters has been stored in said buffer memory, and before said first line is printed, so as to feed said disposable ribbon by a predetermined distance corresponding to a preset maximum number of characters printable per line, less a distance of a blank which is to be left before a first character of said first line, whereby said first line can be printed without using any segment of an active portion of the ribbon which was used for the last line printed in the last printing cycle.

* * * * *